United States Patent [19]

Rumble

[11] 4,416,502

[45] Nov. 22, 1983

[54] ELECTRICAL CONNECTOR

[75] Inventor: Clive Rumble, London, England

[73] Assignee: Corabelment A.G., Vaduz, Liechtenstein

[21] Appl. No.: 287,914

[22] Filed: Jul. 29, 1981

[51] Int. Cl.[3] ..... H01R 13/58; H01R 29/00

[52] U.S. Cl. ..... 339/103 M; 339/31 R

[58] Field of Search ..... 339/31 RM–103 RM, 339/107, 14 P

[56] References Cited

FOREIGN PATENT DOCUMENTS

| | | | |
|---|---|---|---|
| 538291 | 6/1955 | Belgium | 339/31 M |
| 883171 | 11/1961 | United Kingdom | 339/31 R |
| 902775 | 8/1962 | United Kingdom | 339/31 R |

*Primary Examiner*—Eugene F. Desmond

*Attorney, Agent, or Firm*—Stevens, Davis, Miller & Mosher

[57] ABSTRACT

An electrical connector used as a plug for an electrically powered appliance comprises a body 1 and a casing 12 with a hole 18 through which a cable 19 from the appliance enters. The cable is connected to terminals 9, in turn connected to plates 23 behind which selectively extendable pairs of contact pins 3 are positioned.

8 Claims, 4 Drawing Figures

ELECTRICAL CONNECTOR

DESCRIPTION

This invention relates to an electrical connector which has a front end part with at least one frontwardly extending array of electrically conductive pins to mate with a corresponding array of sockets in an electric power point.

More specifically the invention is concerned with an electrical connector wherein a plurality of pin arrays are selectively available at the front end. Each array has the pins retractable into the body of the adaptor and means are provided for securing the pins in their projecting functional positions.

The connector in accordance with the present invention is characterized in that the rear end is formed to receive an electrical cable to an appliance and in that terminals to receive the bared ends of the cable wires and electrically connect them to the pins are provided within the connector.

Effectively therefore the connector is a multi-pin plug for a flexed appliance such as a smoothing iron.

In one embodiment of the present invention, electrically conductive pins extend from electrically conductive plates with, a live plate and a neutral plate being positioned behind a masking member which is movable so as to selectively expose the live and neutral pins of a desired array. The plates are then electrically connected to respective sockets at the rear end of the adaptor.

A particular embodiment of the invention will now be described by way of example and with reference to the drawings wherein.

Figure 1:
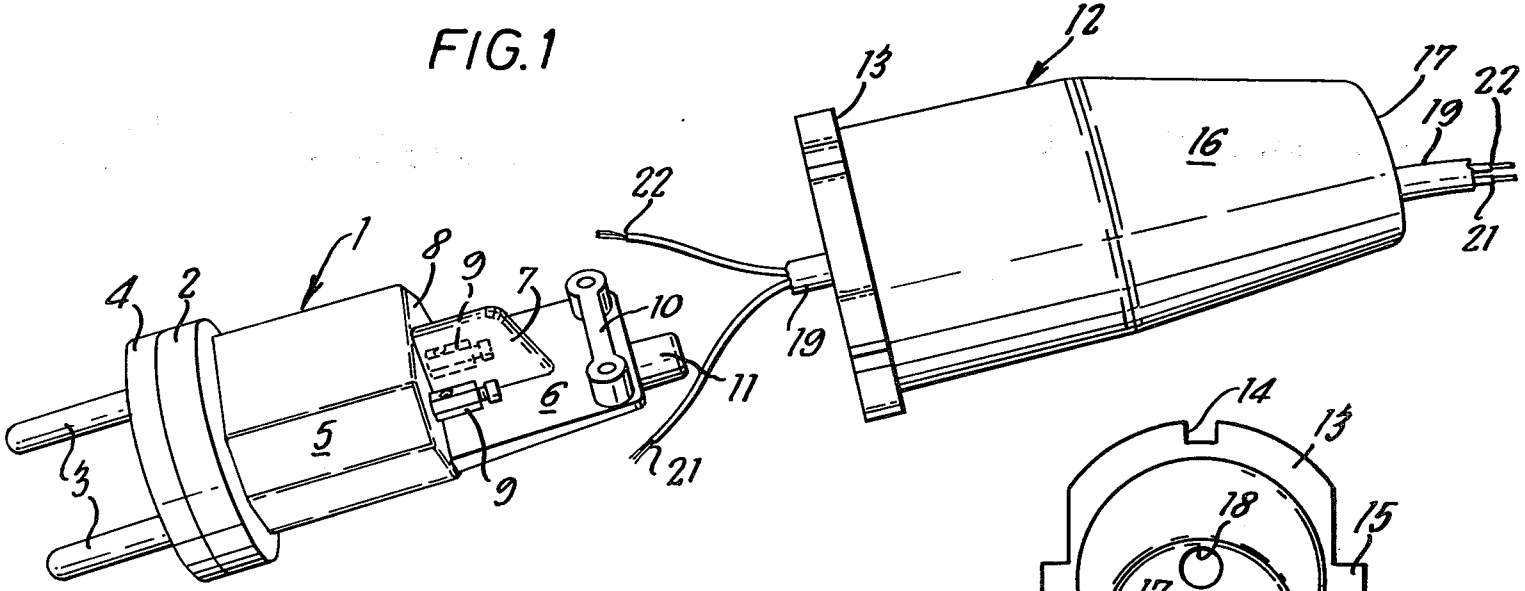
FIG. 1 is an exploded perspective view of a connector in accordance with the invention.

Referring initially to FIG. 1 of the drawings, the electrical connector illustrated therein comprises a body 1 with a disc-shaped front end portion 2 from which conductive pins 3 extend through a masking member 4 in a manner to be described subsequently. The body has a rearwardly extending polygonal portion 5 from which extends rearwardly a platform 6 and a strengthening rib 7. The wall 8 between platform 6 and portion 5 has fixed to it one on either side of rib 7 electrical terminals 9. A clamping element 10 is adjustably fixed to the platform 6 so as to be raiseable and lowerable to grip a cable under it. An internally threaded spigot extends under the platform 6.

Figure 3:
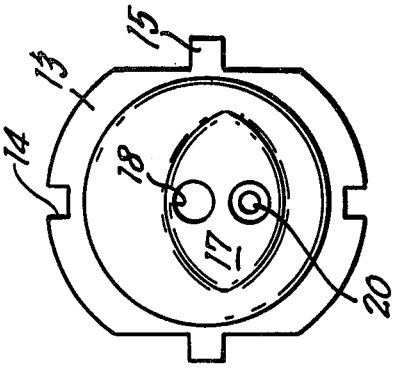
FIG. 3 is a rear end view.

A casing 12 has a front end part whose interior is dimensioned to fit over the disc-shaped front part 2 of body 1. A rim 13 (see also FIG. 1) has indentations 14 and projections 15 to enter into recessed electrical sockets with corresponding locating devices, such as are used on the continent of Europe. A rearwardly tapered part 16 of body 12 terminates in a flat end face 17, which is eliptical when viewed end-on (see FIG. 3), and has a first hole 18 for admitting cable 19 and a second countersunk hole 20 for receiving a screw to enter into threaded spigot 11 and to hold the casing onto the body in the manner illustrated in FIG. 1. The rear end part of the cable 19 extends and is connected to an electrical appliance such as a travelling iron (not shown). The cable 19 includes a live wire 21 and a neutral wire 22. The wires 21 and 22 when in use are respectively held by terminals 9, the cable being gripped under clamping member 10.

Figure 2:
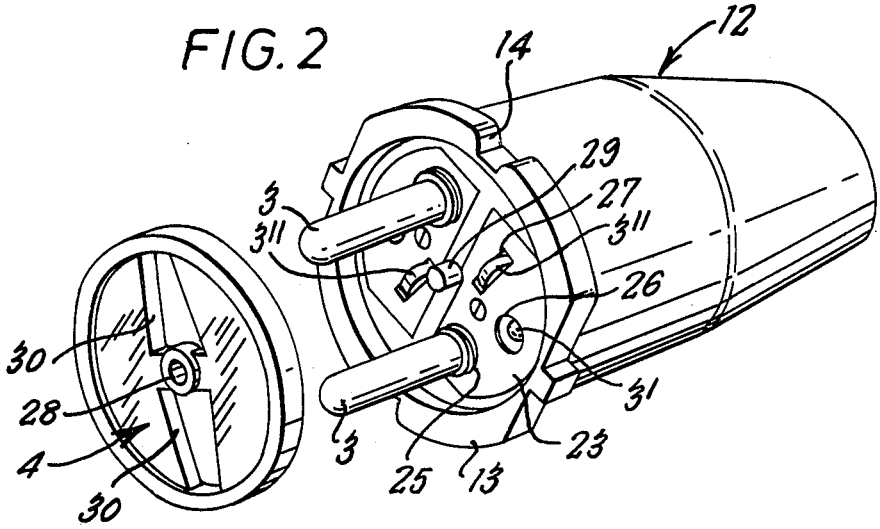
FIG. 2 is a front view of the connector with the masking plate removed.
Figure 4:
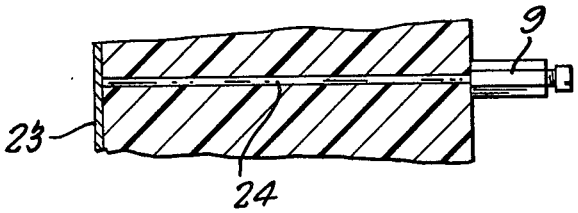
FIG. 4 is a sectional view showing the electrical connection between the front and rear ends of the connector.

Referring now to FIG. 2 of the drawings the front end part of the body defines a supporting structure having shallow recesses within which are positioned two electrically conductive metal plates 23 each plate being conductively connected by an elongate conductive member 24 to the respective one of terminals 9 (see FIG. 4). Thus one plate 23 will be a live plate and the other plate a neutral plate. Each plate 23 has three apertures and behind each aperture is a socket housing a contact pin slidable between a retracted position behind the plate and an extended position extending frontwardly from the plate to enter into a main socket. Thus in the embodiment illustrated each plate 23 has a first round hole 25, a second and smaller round hole 26 and a rectangular hole 27. As illustrated contact pins 3 extend from each of the larger round bores 25 and have threaded bases which are engaged with corresponding threads in the holes thereby maintaining the pins in the extended position. Thus a pair of pins 3, a live pin and a neutral pin, extend from the front of the body 1 to be inserted into an electrical socket.

Two other pairs of pins are selectable, the smaller round pins 3′ and the rectangular pins 3″ which can be seen in the retracted position. The rectangular pins are held against springs in the socket bases and when withdrawn are turned through 90° and held by the spring bias.

The masking plate 4 has a socket 28 engaged on pin 29 and rotatable on the pin for opposed windows 30 selectively to expose pairs of pins 3 to be extended and fixed.

A socket, either electrically insulated and blind, or electrically connected to a cable wire may be provided in the body to receive a projecting earth pin on a power socket.

In the construction described above the body and casing main parts are moulded from plastics.

In an alternative construction the rim 13 with indentations 14 and projections 15 is formed on the masking plate.

I claim:

1. An electrical connector comprising:

a body within which a plurality of extendable electrically conductive pins are housed, said body having a front end portion and a rearwardly extending portion;

a plurality of electrically conductive plates mounted at the front end portion of said body, each of said plates having apertures therein;

a plurality of pairs of electrically conductive pins slidably mounted in said body so as to be movable between a retracted position behind said plates and an extended functional position extending frontwardly through respective apertures of said plates, said pins having a rear portion, the rear portion of said pins being in electrical contact with a respective plate of said plurality of plates when said pins are in the extended functional position;

a rotatable masking means mounted in front of said plates, said masking means having opposed windows therein so as to allow the selective exposure and extension of a pair of said electrically conductive pins;

a plurality of electrical terminals at the rearwardly extending portion of said body;

a plurality of electrical connections extending through said body, each of said connections extending from a respective terminal of said plurality of terminals through said body to a respective plate of said plurality of plates; and a casing receiving said body, said casing having a rearwardly extending socket capable of receiving an electrical cable.

2. An electrical connector according to claim 1, wherein the rearwardly extending portion of said body comprises a wall portion having said electrical terminals emerging therefrom and a platform located below said wall portion, said platform carrying a clamping means capable of securing an electrical cable end part.

3. An electrical connector according to claim 1, wherein means for securing said electrically conductive pins in their extended functional position are provided.

4. An electrical connector according to claim 1, wherein said plurality of electrically conductive plates comprises a pair of electrically conductive plates.

5. An electrical connector according to claim 4, wherein one of said plates is a live plate and the other plate is a neutral plate.

6. An electrical connector according to claim 5, wherein one pin of an extended pair of pins is in electrical contact with said live plate and the other pin is in electrical contact with the neutral plate.

7. An electrical connector according to claim 4, wherein each of said plates has three apertures therein.

8. An electrical connector according to claim 1, wherein said body is provided with a socket for receiving a ground pin projecting from a power source socket.

* * * * *